US006877703B2

(12) United States Patent
Tang

(10) Patent No.: US 6,877,703 B2
(45) Date of Patent: Apr. 12, 2005

(54) SUSPENDING STRUCTURE OF CEILING FAN

(76) Inventor: David Tang, No. 3, Alley 5, Lane 66, Yangming St., Fengyuan City, Taichung Hsien (JP)

( * ) Notice: Subject to any disclaimer, the term of this patent is extended or adjusted under 35 U.S.C. 154(b) by 0 days.

(21) Appl. No.: 10/463,972

(22) Filed: Jun. 17, 2003

(65) Prior Publication Data

US 2004/0256531 A1 Dec. 23, 2004

(51) Int. Cl.[7] ..... B42F 13/00

(52) U.S. Cl. ..... 248/342; 248/222.52; 248/220.22; 248/343; 416/244 R; 416/5

(58) Field of Search ..... 248/342, 343, 248/222.52, 220.21, 220.22, 317; 416/5, 244 R, 210 R

(56) References Cited

U.S. PATENT DOCUMENTS 1,738,652 A * 12/1929 Hulse ..... 248/343
2,249,331 A * 7/1941 Sachs ..... 248/343
2,924,417 A * 2/1960 Bodian ..... 248/343
2,943,137 A * 6/1960 Wyngarden ..... 174/61
3,112,891 A * 12/1963 Cutler ..... 362/216
4,448,388 A * 5/1984 Dennis et al. ..... 248/663
5,349,513 A * 9/1994 Taylor, III ..... 362/404
5,613,832 A * 3/1997 Su ..... 416/244 R
5,900,583 A * 5/1999 Russo ..... 174/61
6,439,527 B1 * 8/2002 Lin ..... 248/343
6,558,124 B2 * 5/2003 Bucher et al. ..... 416/244 R

* cited by examiner

*Primary Examiner*—Anita King
*Assistant Examiner*—Naschica S. Morrison
(74) *Attorney, Agent, or Firm*—Charles E. Baxley

(57) ABSTRACT

A suspending structure of ceiling fan generally comprises a mounting bracket, a C-shape ring and a canopy. Wherein both the mounting bracket and the C-shape ring are provided with a gap respectively, when the gap of the mounting bracket is aligned to that of the C-shape ring the downrod is is permitted to allow for the entrance of the downrod. And then the C-shape ring is revolved to make its gap not aligned with that of the mounting bracket, such that the entrance of the downrod is enclosed, that is to say, the downrod will be rigidly fixed and the disengagement of it can be definitely prevented, thereby the suspending structure of ceiling fan of the present invention is very safe in operation.

1 Claim, 7 Drawing Sheets

SUSPENDING STRUCTURE OF CEILING FAN

BACKGROUND OF THE INVENTION

1. Field of the Invention

The present invention relates to a suspending structure of ceiling fan, and more particularly to a suspending structure of ceiling fan which is capable of preventing disengagement of the hanging ball of the downrod/ball assembly.

2. Description of the Prior Arts

A conventional suspending structure of ceiling fan as shown in FIG. 1, which generally comprises a mounting bracket 10 and a canopy 11. Wherein the hanging bracket 10 is a hollow member and to be fixed to the ceiling or wall, which is provided with a plurality of threaded holes 101 at both sides and at a side of which thereof a gap 102 is defined. The canopy 11 is approximately cone-shaped hollow member, and provided with a plurality of through holes 111 corresponding to the threaded holes 101 of the mounting bracket 10. The canopy 11 and mounting bracket 10 can be combined together by passing a plurality of bolts 112 through the through holes 111 and engaged with the respective threaded holes 101. It seems that this kind of suspending structure can be provided for hanging the downrod 12. In some special cases, however, such as when the mounting bracket 10 is fixed to an inclined wall or ceiling, the downrod 12 is susceptible to disengagement from the gap 102. In other words, the ceiling fan will drop down and possibly injure the user once the downrod 12 disengages of the mounting bracket 10.

The present invention has arisen to mitigate and/or obviate the afore-described disadvantages of the conventional suspending structure of ceiling fan.

SUMMARY OF THE INVENTION

In accordance with one aspect of the present invention, the suspending structure of ceiling fan generally comprises a mounting bracket, a C-shape ring and a canopy. Wherein both the mounting bracket and the C-shape ring are provided with a gap respectively, when the gap of the mounting bracket is aligned to that of the C-shape ring, the downrod is allowed for entrance of the downrod. And then the C-shape ring is revolved to make its gap not aligned with that of the mounting bracket, such that the entrance of the downrod is enclosed, that is to say, the downrod will be rigidly fixed and the disengagement of it can be definitely prevented, thereby the suspending structure of ceiling fan of the present invention is very safe in operation.

The present invention will become more obvious from the following description when taken in connection with the accompanying drawings, which shows, for purpose of illustrations only, the preferred embodiment in accordance with the present invention.

DETAILED DESCRIPTION OF THE PREFERRED EMBODIMENT

Figure 1:
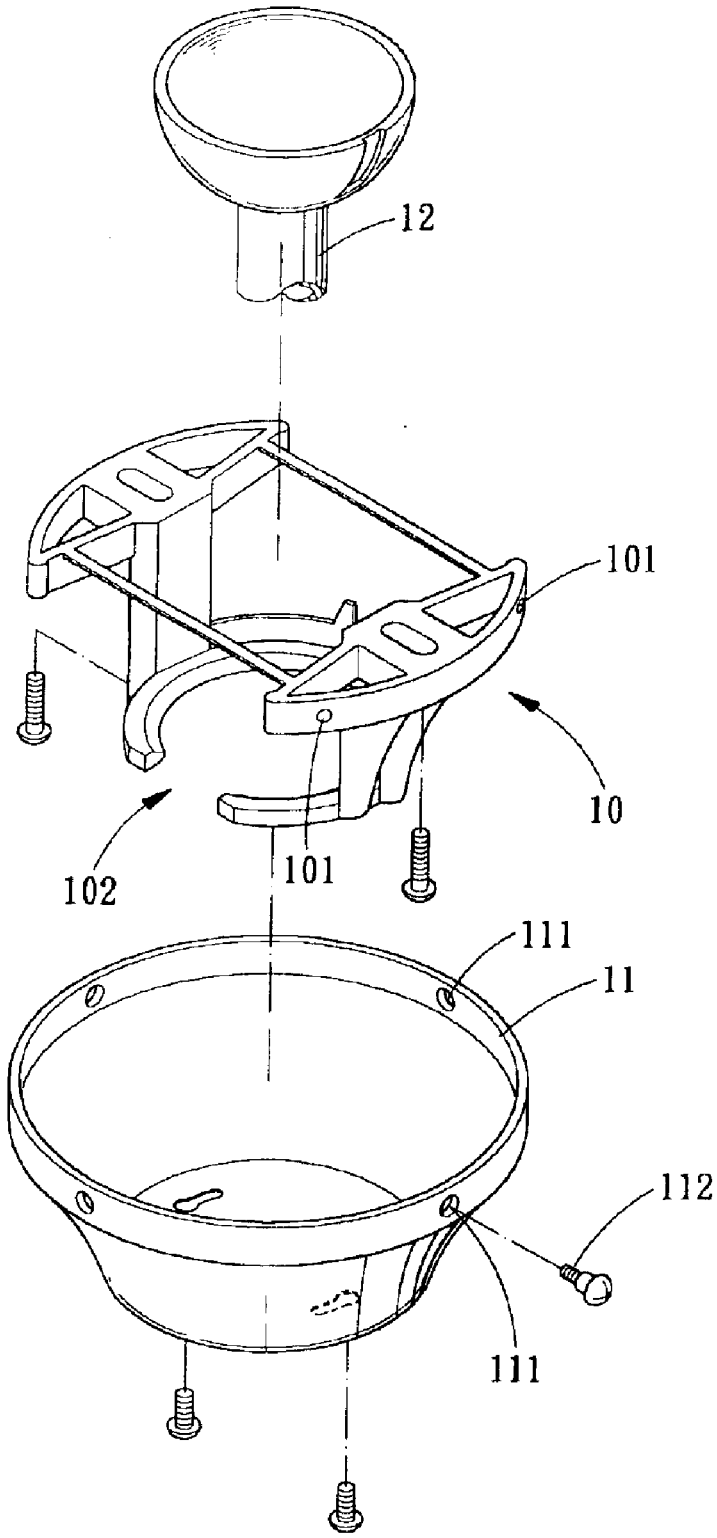
F I G. 1 PRIOR ART
FIG. 1 is an exploded view of a conventional suspending structure of ceiling fan.
Figure 2:
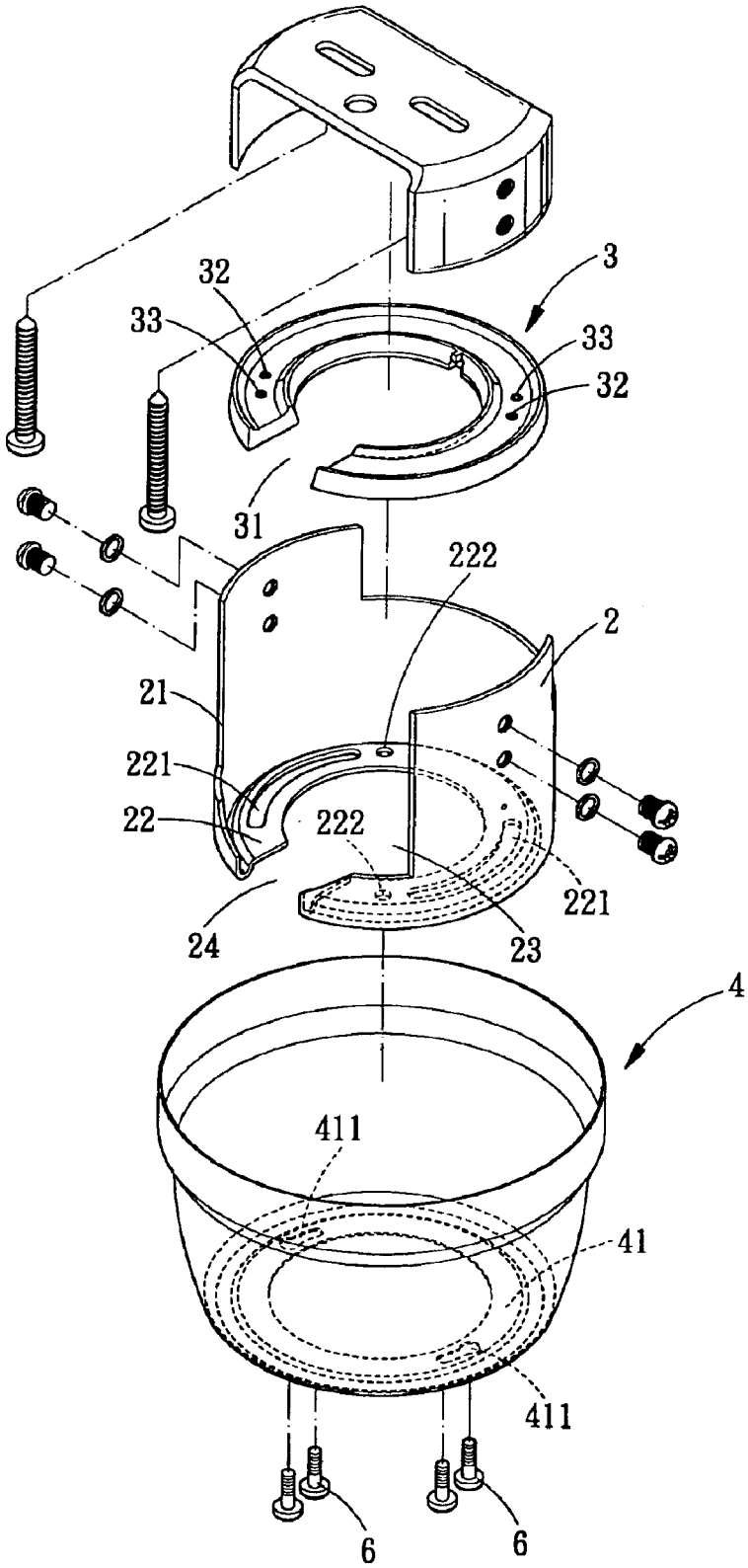
FIG. 2 is an exploded view of a suspending structure of ceiling fan in accordance with the present invention.
Figure 3:
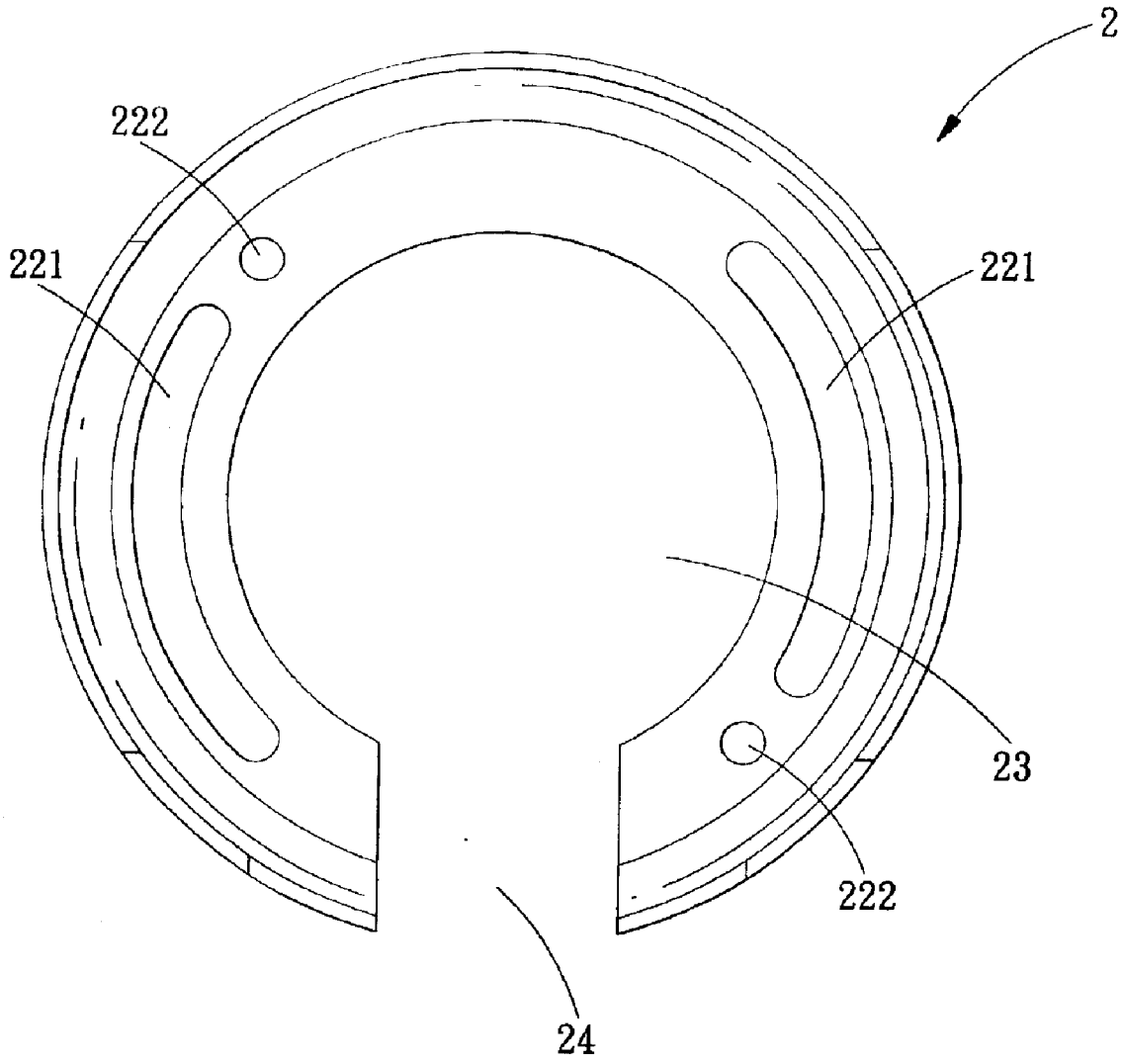
FIG. 3 is a top view of a mounting bracket of the suspending structure of ceiling fan in accordance with the present invention.
Figure 4:
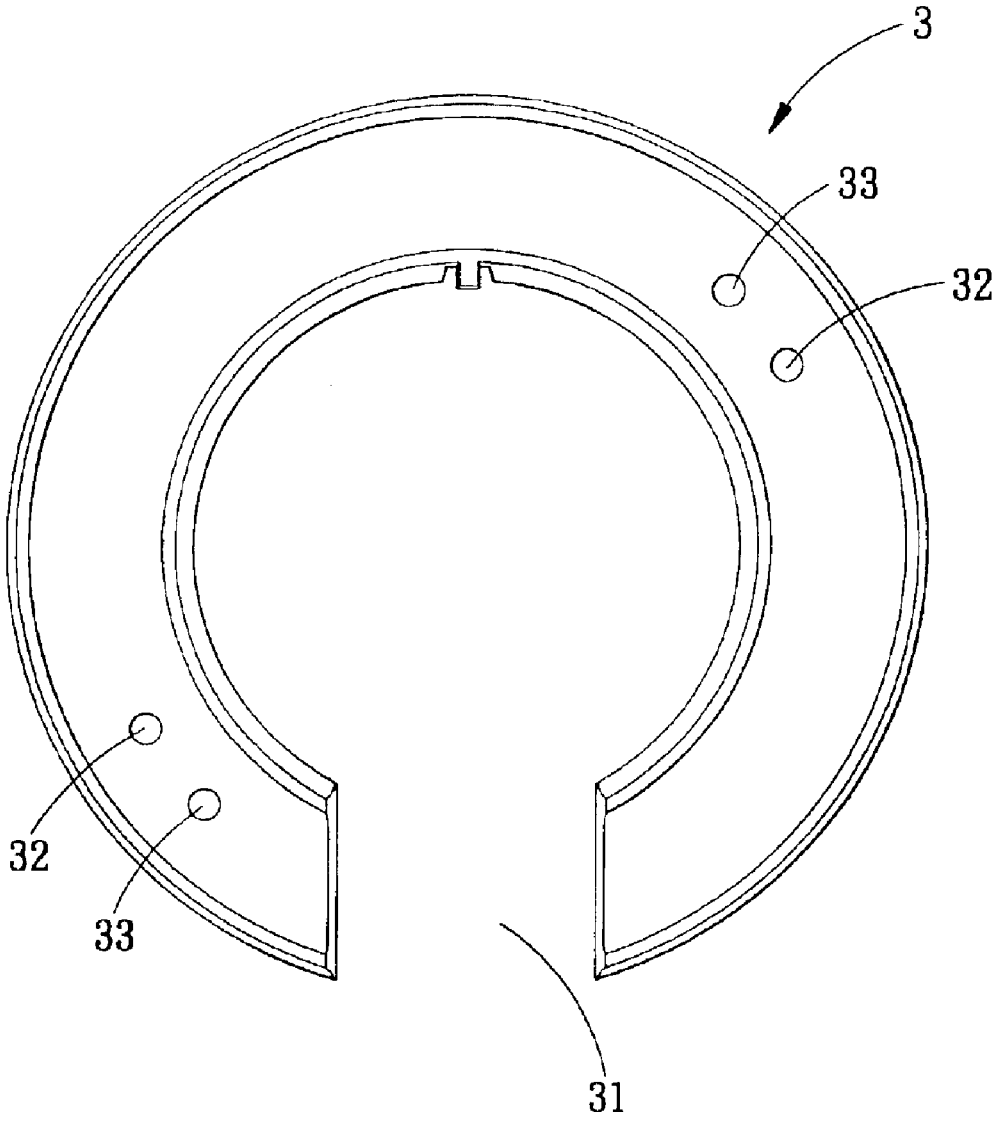
FIG. 4 is a top view of a C-shape ring of the suspending structure of ceiling fan in accordance with the present invention.

Referring to FIGS. 2–5, a suspending structure of ceiling fan generally comprises a mounting bracket 2, a C-shape ring 3 and a canopy 4.

The mounting bracket 2 is a hollow bracket provided with a mouth 21 at a side and a flange 22 formed at the bottom thereof for defining a positioning hole 23, which is further provided with a gap 24 for connecting with outside. In addition, at certain positions of the flange 22 a pair of opposite sliding slots 221 and a pair of opposite locking orifices 222 are defined respectively.

Figure 5:
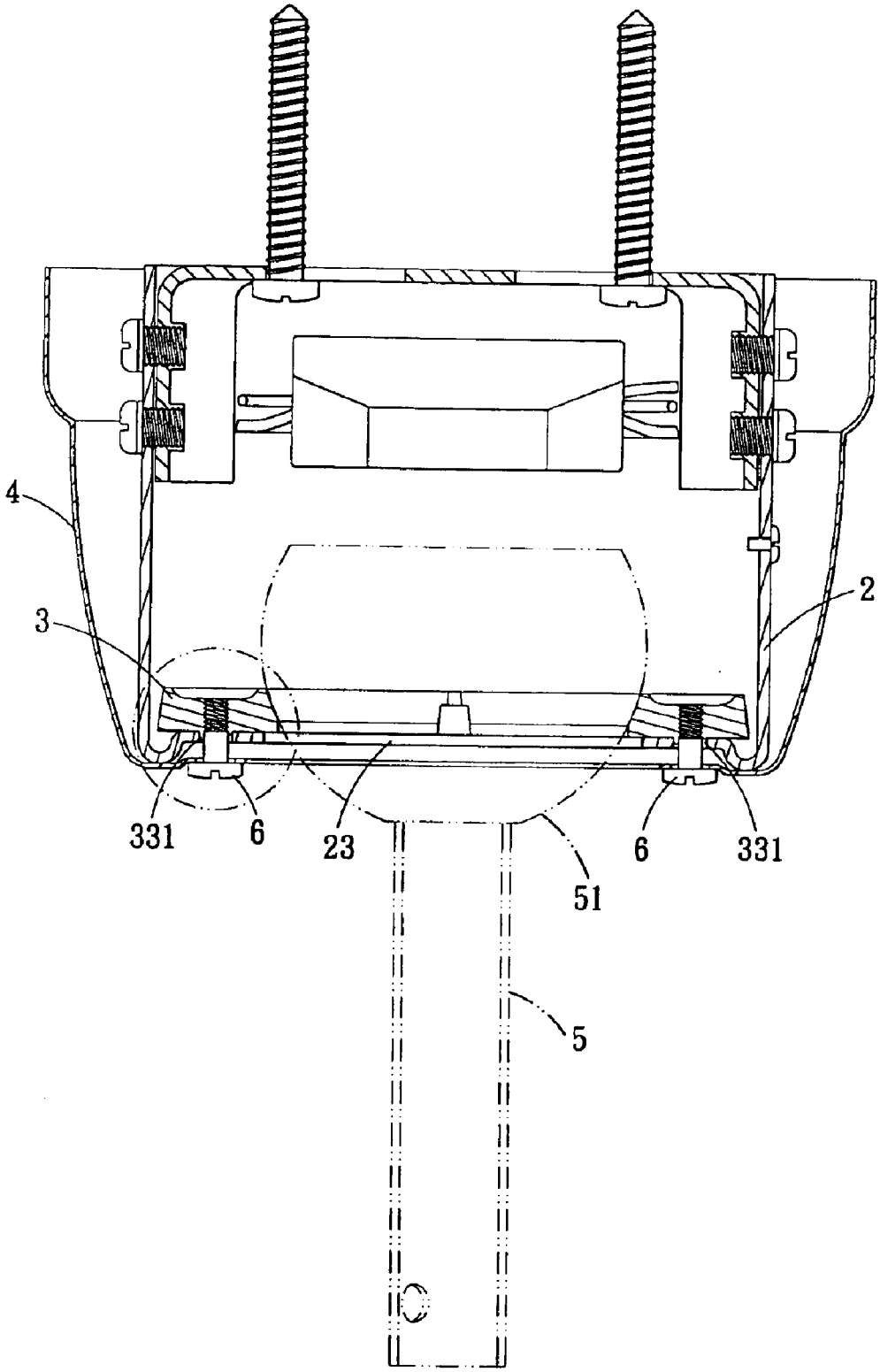
FIG. 5 is a cross sectional view of the suspending structure of ceiling fan in accordance with the present invention.

The C-shape ring 3 serves for receiving and positioning a hanging head 51 of a downrod 5 (as shown in FIG. 5), the shape of the C-shaped ring 3 is corresponding to that of the flange 22 of the mounting bracket 2 and the C-shaped ring 3 is defined with a gap 31. On the C-shape ring 3 two pairs of threaded holes 32, 33 are formed. Wherein one of the two pairs of threaded holes 33 each is provided with a downward protrusion 331 respectively. The C-shape ring 3 is fixed to the flange 22 of the hanging bracket 2 by inserting the protrusions 331 of the threaded holes 33 into the sliding slots 221 of the mounting bracket 2, while making the other of the two pairs of threaded holes 32 timely match with the locking orifices 222 in the mounting bracket 2.

The canopy 4 is employed to be mounted to the outside of the mounting bracket 2, which is provided with a flange 41 at the bottom and on the flange 41 a pair of opposite holes 411.

Figure 6:
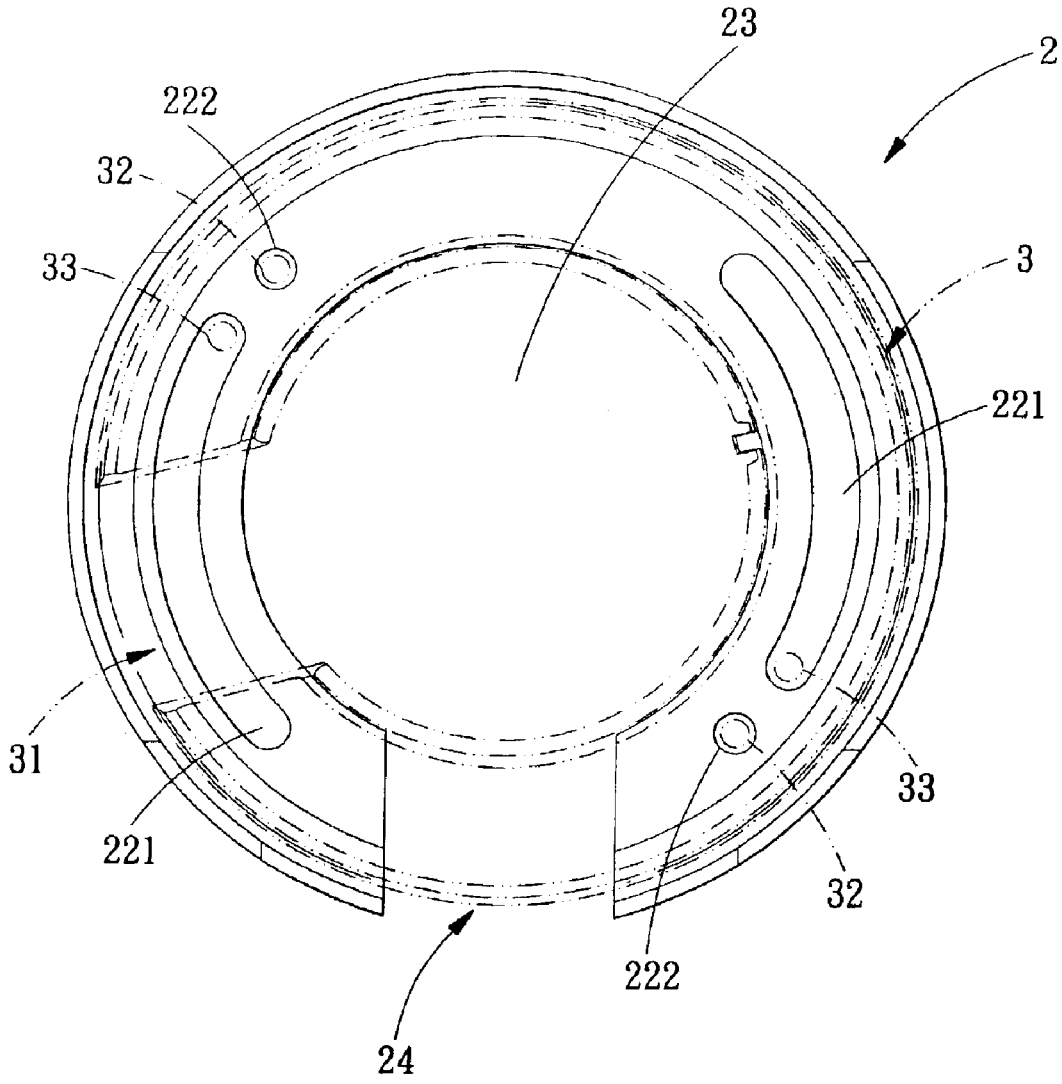
FIG. 6 is a bottom view of combination of the C-shape ring and the mounting bracket of the suspending structure of ceiling fan in accordance with the present invention.
Figure 7:
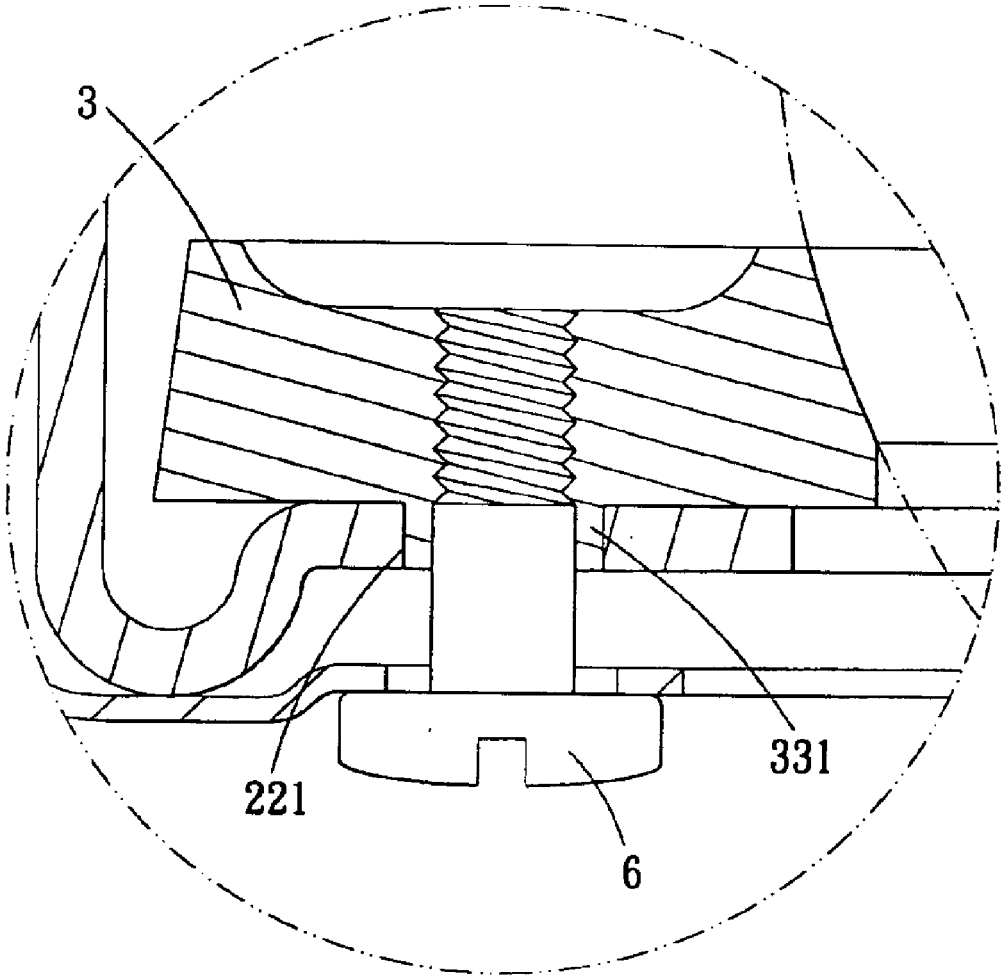
FIG. 7 is a partial amplified view of the down protrusion taken from FIG. 5.

In order to prevent disengagement of the hanging head 51 of the downrod 5 from the C-shape ring 3, in assembly, the user should move the hanging head 51 of the downrod 5 in the C-shape ring 3 initially, and then revolve the C-shape ring 3 to make the protrusions 331 of the threaded holes 33 move along the sliding slots 221 of the mounting bracket 2, such that the positioning hole 23 will be enclosed without connecting to outside (see in FIG. 6) once the C-shape ring 3 is positioned by rotation. At that moment, the mounting bracket 2, the hanging head 3 and the canopy 4 can be rigidly combined together by passing bolts 6 through the holes 411 of the canopy 4 and the locking orifices 222 of the mounting bracket 2 and engaging with threaded holes 32 of the C-shape ring respectively. By such arrangements, the suspending structure of ceiling fan in accordance with the present invention is not only capable of facilitating assembly but also preventing the disengagement of the hanging head 51 of the downrod 5.

While we have shown and described various embodiments in accordance with the present invention, it should be clear to those skilled in the art that further embodiments may be made without departing from the scope of the present invention.

What is claimed is:

1. A suspending structure of ceiling fan comprising:

a mounting bracket being a hollow bracket provided with a mouth at a side and a flange formed at the bottom thereof for defining a positioning hole, which further is provided with a gap for connecting with outside, in addition, at certain positions of the flange are a pair of opposite sliding slots and a pair of opposite locking orifices defined respectively;

a C-shape ring for receiving and positioning a hanging head of a downrod, the shape of the C-shape ring corresponding to that of the flange of the mounting bracket and the C-shape ring is defined with a gap, on the C-shape ring two pairs of threaded holes are formed corresponding to each other, wherein the holes of one of the two pairs of threaded holes are each provided with a downward protrusion respectively, the C-shape ring is fixed to the flange of the hanging bracket by inserting the protrusions of the threaded holes into the sliding slots of the mounting bracket, while making the other of the two pairs of threaded holes timely match with the locking orifices in the mounting bracket;

a canopy employed to be mounted to the outside of the mounting bracket, the canopy having a flange defined at the bottom and on the flange formed with a pair of opposite holes, such that once the C-shape ring is positioned after rotation, the positioning hole on the mounting bracket will be closed without connecting to outside, at that moment, the mounting bracket, the hanging head and the canopy can be rigidly combined together by passing bolts through the holes of the canopy and the locking orifices of the mounting bracket and engaging with the threaded holes of the C-shape ring respectively.

* * * * *